United States Patent [19]

Brown

[11] 4,067,685

[45] Jan. 10, 1978

[54] FUEL INTRODUCTION SYSTEM

[75] Inventor: Frank E. Brown, Coweta, Okla.

[73] Assignees: Ellis A. Creek; Richard W. Brown, both of Coweta, Okla. ; part interest to each

[21] Appl. No.: 710,345

[22] Filed: July 30, 1976

Related U.S. Application Data

[63] Continuation of Ser. No. 350,947, April 13, 1973, abandoned, which is a continuation-in-part of Ser. No. 315,537, Dec. 15, 1972, abandoned.

[51] Int. Cl.[2] ..... F02M 27/02

[52] U.S. Cl. ..... 431/2; 123/119 E; 48/180 C

[58] Field of Search ..... 431/2; 123/119 E, 3; 48/180, 180 C, 180 M

[56] References Cited

U.S. PATENT DOCUMENTS

| | | | |
|---|---|---|---|
| 921,934 | 5/1909 | Willard | 48/180 M |
| 1,288,640 | 12/1918 | Mauck | 48/180 M |
| 1,777,554 | 10/1930 | Ducloux | 123/119 E |
| 1,795,037 | 3/1931 | Portail | 123/119 E |
| 1,815,177 | 7/1931 | Balachowsky et al. | 123/119 E |
| 2,006,367 | 7/1935 | Rathburn | 123/119 E |
| 2,206,685 | 7/1940 | Balachowsky | 123/119 E |
| 2,899,949 | 8/1959 | Hicks | 48/180 R |
| 3,380,245 | 4/1968 | Mick | 123/119 E |
| 3,682,608 | 8/1972 | Hicks | 48/180 C |

FOREIGN PATENT DOCUMENTS

| | | | |
|---|---|---|---|
| 965,454 | 7/1964 | United Kingdom | 123/119 E |

*Primary Examiner*—Carroll B. Dority, Jr.
*Attorney, Agent, or Firm*—Head, Johnson & Chafin

[57] ABSTRACT

A system for introducing fuel into a fuel burning chamber or area wherein an extremely lean mixture of air and fuel is directed through a catalyst into a blending chamber and is discharged from the blending chamber through a second catalyst into an ignition or burning chamber. The system may be used efficiently with low grade or heavier fuel. When using the low grade or heavier fuels, it is desirable to heat or vaporize the fuel prior to the introduction thereof into an atomizer or the catalyst and substantially complete combustion occurs in the ignition or burning chamber for substantially eliminating the emission of unburned hydrocarbons, thus not only conserving fuel but also reducing air pollution.

3 Claims, 1 Drawing Figure

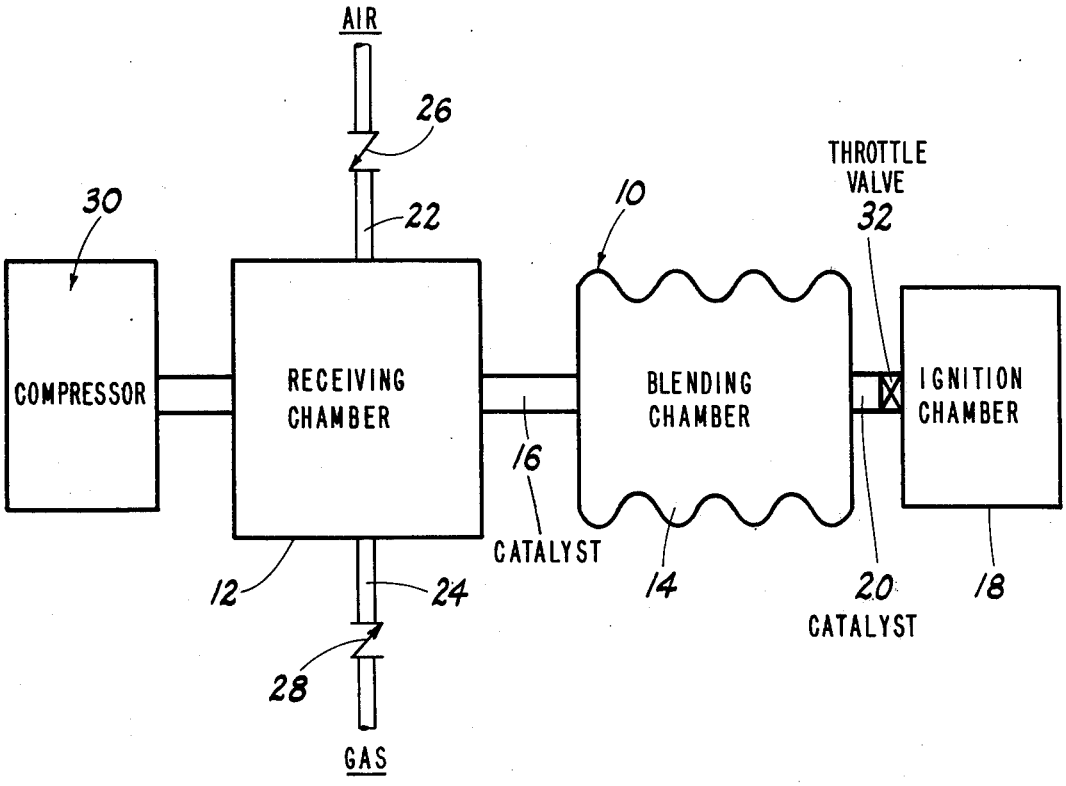
AIR
26
22
30
10
THROTTLE
VALVE
32
COMPRESSOR
RECEIVING
CHAMBER
BLENDING
CHAMBER
IGNITION
CHAMBER
16
CATALYST
12
24
14
20
CATALYST
18
28
GAS

FUEL INTRODUCTION SYSTEM

CROSS-REFERENCE TO RELATED APPLICATION

This is a continuation application of Ser. No. 350,947 filed Apr. 13, 1973 and now abandoned. Application Ser. No. 350,947 is a continuation-in-part application of my prior application Ser. No. 315,537 filed Dec. 15, 1972, and entitled "Fuel Introduction System" and now abandoned.

BACKGROUND OF THE INVENTION

This invention relates to improvements in fuel systems for devices which burn air-gas mixtures, and more particularly, but not by way of limitation, to a fuel introduction system wherein a lean air-gas mixture is directed to a burning chamber for substantially complete combustion for conserving fuel and reducing air pollution.

SUMMARY OF THE INVENTION

The present invention relates to a method of directing an extremely lean air-gas mixture into an ignition or burning chamber of substantially any device designed and constructed for the purpose of burning air-gas mixtures for the generation of heat or power, but more particularly for use in conjunction with internal combustion engines. The novel method comprises the steps of admitting air and fuel into an initial chamber in ratios wherein the volume of air is considerably greater than the volume of fuel, thus providing an extremely lean fuel mixture. The volume of air and gas is moved from the initial chamber through a mixing or blending chamber and into an ignition or burning chamber or area wherein substantially complete combustion occurs. The novel system may be utilized with great efficiency even with low grade or heavy fuels, in which instance it is desirable to heat the fuel at some stage prior to the admission thereof into the combustion chamber. The novel system not only conserves fuel by efficiently utilizing a lean fuel mixture, but also reduces or substantially eliminates the emission of hydrocarbon in the exhaust gases for greatly reducing air pollution.

BRIEF DESCRIPTION OF THE DRAWINGS

The FIGURE is a schematic representation of a fuel introduction system embodying the invention.

DESCRIPTION OF THE PREFERRED EMBODIMENT

Referring to the drawing in detail, reference character 10 generally indicates a system comprising an initial air-fuel receiving chamber 12 in communication with a blending or mixing chamber 14 through a suitable catalyst element 16, which may be in the form of a wire screen or mesh. The chamber 14 in turn is in communication with a burning area or ignition chamber 18 through a second catalyst 20, which may also be in the form of a wire screen or mesh. The system 10 may be utilized in substantially any device designed for the burning of air-gas mixtures for the generation of heat or power, but it is preferable that the system be utilized in conjunction with an internal combustion engine or power plant. When the device is utilized with an internal combustion engine (not shown) the ignition chamber 18 may be the normal or usual ignition chamber of the engine wherein combustion occurs for operation of the pistons (not shown) of the engine.

The initial receiving chamber 12 may be provided with suitable conduits 22 and 24 whereby air and fuel may be independently directed into the chamber 12 in substantially any desired air-gas or air-fuel ratio. The fuel utilized may be of any suitable type which is combustible when mixed with air, such as a hydrocarbon, or the like, and it is desirable that the ratio of air to fuel be selected in order that the mixture introduced into the system 10 is an extremely lean fuel mixture. For example, a ratio of twenty volumes of air to one volume of hydrocarbon, such as methane, or the like, has been found to provide excellent results, but there is no intention of limiting the invention to this particular air-gas or air-fuel ratio. As shown herein, the conduits 22 and 24 are provided with suitable check valves 26 and 28, respectively, for facilitating the admission of the air and gas or fuel into the chamber 12 as will be hereinafter set forth. The fuel may be directed through an atomizer or the like (not shown) if desired prior to passage of the fuel and air through the catalyst 16.

A suitable compressor, turine, or the like, is generally indicated at 30, and as illustrated herein, the compressor 30 is in communication with the chamber 12 for providing sufficient pressure therein to move the fuel and air within the chamber 12 into the blending chamber 14. The valves 26 and 28 preclude accidental discharge or escape of the pressure from the chamber 12 through the lines 22 and 24.

The air-fuel mixture in the chamber 12 is moved into the mixing or blending chamber 14 through the catalyst 16 in any well known manner, such as by an atomizer (not shown), or fuel nozzle (not shown), or the like. The catalyst 16 is preferably in the form of a mesh screen, but not limited thereto. The mixing chamber 14 may be of any suitable construction whereby the movement of the air-fuel mixture therethrough is in a tortuous path or the mixture therein is agitated for achieving a complete blending of the mixture prior to discharge therefrom. In order to achieve an efficient blending of the air-fuel mixture within the chamber 14, the chamber 14 may be provided with an internal helical baffle (not shown) for directing the flow through the chamber in a tortuous path. Alternately, the inner periphery of the chamber 14 may be undulated, or may be roughened in any suitable manner, which has been found to provide sufficient turbulence in the flow through the chamber 14 for completely blending the air-fuel mixture therein.

When heavier fuels are used, it is desirable to heat or vaporize the fuel prior to introduction thereof into the atomizer, or the like (not shown). This may be accomplished in any suitable manner, such as by a heating sump wherein the heat is supplied by the engine exhaust gasses. Propane fuels have been found to function extremely efficiently in the novel fuel injection system, and it is also possible to use diesel fuel, stove oil, or the like, with superior results. In addition, it has been found that the usual or standard air filter (not shown) frequently utilized in conjunction with the usual internal combustion engine, or the like, may be used as the blending chamber 16. The normal configuration of the air filter is such as to cause the fuel-air mixture to move in a manner for assuring a complete blending thereof. The blending chamber is an important feature of the novel injection system in that the complete and thorough blending of the air and fuel appears to be important in the efficiency of the subsequent burning of the fuel-air mixture.

The blended mixture is discharged from the chamber 14 in any well known manner, and is directed into the chamber 18 through a second catalyst 20 which is preferably in the form of a mesh screen. The pressure of the blended mixture entering the chamber 18 may be greater than atmospheric pressure, may the substantially atmospheric pressure, or may be less than atmospheric, as desired and in accordance with the operating conditions and performance of the engine, or the like, using the fuel injection system. Of course, the pressure may waiver during operation of an engine from some pressure below atmospheric pressure to some pressure above atmospheric pressure and back again to some pressure below atmospheric pressure as the engine is actuated under normal operating conditions, as is well known. It is to be noted that the fuel-air mixture being directed into the chamber 18 is a combustible mixture ready for ignition.

Of course, it will be apparent that a suitable throttle valve 32 is preferably provided between the catalyst 20 and the chamber 18, or in the chamber 18, as desired for receiving the fuel mixture and regulating the quantity of fuel flow into the chamber 18 for ignition, as is well known. For example, in the utilization of the novel system with an internal combustion engine, the throttle valve 32 may be in the form of the usual engine throttle valve actuated by the usual accelerator pedal, as is well known. It is to be understood that one of the catalysts may be eliminated, if desired, but it is desirable to use at least one catalyst.

When the novel fuel injection system is utilized in burners or heaters, or the like, it has been found that the method produces an extremely hot flame. In addition, the lean fuel mixture results in a conservation of fuel regardless of the environment wherein the invention is utilized. Furthermore, there is substantially complete combustion in the firing chamber 18, which substantially eliminates monoxide or unburned hydrocarbons in the exhaust gasses, thus, greatly reducing air pollution.

Whereas the system as described hereinbefore results in a substantially complete combustion of the air-fuel mixture for greatly reducing air pollution, it has been further found that in instances wherein it is possible to inject the air-fuel mixture entering the blending chamber 14 is at a pressure at least slightly greater than or in excess of atmospheric pressure. The combination of the thorough blending of the air and fuel with the pressure in excess of atmospheric pressure results in an even greater totality of the combustion of the fuel mixture in the combustion chamber 18. In circumstances wherein it is possible and practical to increase the pressure of the air and fuel intering the blending chamber 16 to something in excess of atmospheric pressure, an almost total or complete combustion of the mixture occurs.

From the foregoing it will be apparent that the present invention provides a novel fuel introduction system for use in connection with substantially any device designed for the purpose of burning air-gas or air-fuel mixtures for the generation of heat or power, or for any other reasons. A lean air-fuel mixture is directed into an initial chamber, thoroughly blended, and introduced into a firing chamber or combustion chamber at substantially any desired pressure, in accordance with the performance requirements of the combustion process. The novel method is particularly arranged for the conservation of fuel by permitting the use of an extremely lean fuel mixture and for reducing air pollution by providing for substantially complete combustion of the fuel mixture in the firing chamber Whereas the present invention has been described in particular relation to the drawings attached hereto, it should be understood that other and further modifications, apart from those shown or suggested herein, may be made within the spirit and scope of this invention.

What is claimed is:

1. A fuel introduction method comprising the steps of introducing air and fuel into an initial receiving chamber, passing the air and fuel through a first conduit having a catalyst means, moving the combination of air and fuel into a blending chamber having an undulating inner surface and having a cross-sectional area several times that of said first conduit, completely blending the air and fuel in the blending chamber, moving the blended air and fuel through a second conduit having a catalyst means, and moving the blended combustible air-fuel mixture into a firing chamber.

2. A fuel introduction method as set forth in claim 1 wherein the step of passing the air and fuel through catalyst means comprises moving the air and fuel through a substantially flat catalyst means which is disposed in a plane substantially perpendicular to the direction of flow of the air and fuel.

3. A fuel introduction method as set forth in claim 2 wherein the step of moving air and fuel through a substantially flat catalyst means comprises moving the air and fuel through a first substantially flat mesh screen prior to passage thereof into the blending chamber.

* * * * *